US005205958A

United States Patent [19]

Swatling et al.

[11] Patent Number: 5,205,958

[45] Date of Patent: * Apr. 27, 1993

[54] ZEOLITE AGGLOMERATION PROCESS AND PRODUCT

[75] Inventors: Donald K. Swatling, Oakland; Leslie E. Finn, Fremont; Erle D. Mankin, Concord, all of Calif.

[73] Assignee: The Clorox Company, Oakland, Calif.

[ * ] Notice: The portion of the term of this patent subsequent to Jun. 18, 2008 has been disclaimed.

[21] Appl. No.: 671,277

[22] Filed: Mar. 18, 1991

Related U.S. Application Data

[63] Continuation-in-part of Ser. No. 367,392, Jun. 16, 1989, Pat. No. 5,024,782.

[51] Int. Cl.[5] ..... C11D 7/10; C11D 7/20; C11D 11/00; C11D 17/06

[52] U.S. Cl. ..... 252/174.13; 23/313 R; 252/89.1; 252/140; 252/174.21; 252/174.25; 264/117

[58] Field of Search ..... 252/174.25, 89.1, 91, 252/131, 140, 174, 174.13, 174.14, 174.21, 174.24, 179; 23/313 R, 313 AS; 264/117

[56] References Cited

U.S. PATENT DOCUMENTS

| | | | |
|---|---|---|---|
| 2,630,050 | 4/1951 | Yamanaka et al. | 106/287.17 |
| 3,597,361 | 8/1971 | Sumner | 252/161 |
| 3,609,088 | 9/1971 | Sumner | 252/99 |
| 3,664,961 | 5/1972 | Norris | 252/99 |
| 3,962,132 | 6/1976 | Haschke et al. | 252/430 |
| 4,096,081 | 6/1978 | Phenicie et al. | 252/89 |
| 4,171,280 | 10/1979 | Maddox et al. | 252/186 |
| 4,184,975 | 1/1980 | Krings et al. | 252/174.25 |
| 4,190,551 | 2/1980 | Murata et al. | 252/99 |
| 4,231,887 | 11/1980 | Denny et al. | 252/174.19 |
| 4,243,544 | 1/1981 | Taylor | 252/135 |
| 4,243,545 | 1/1981 | Campbell et al. | 252/140 |
| 4,288,340 | 9/1981 | Dankworth et al. | 252/174.25 |
| 4,288,342 | 9/1981 | Wagner, III et al. | 252/140 |
| 4,347,152 | 8/1982 | Wixon | 252/174 |
| 4,379,080 | 4/1983 | Murphy | 252/526 |
| 4,391,727 | 7/1983 | Benz | 252/99 |
| 4,405,484 | 9/1983 | Miyazaki et al. | 252/174.25 |
| 4,406,808 | 9/1983 | Gangwisch et al. | 252/91 |
| 4,414,130 | 11/1983 | Cheng | 252/174.25 |
| 4,415,489 | 11/1983 | Kiczek et al. | 252/558 |
| 4,473,855 | 9/1984 | Greene | 252/174 |
| 4,510,066 | 4/1985 | Saar | 252/140 |
| 4,528,276 | 7/1985 | Cambell et al. | 252/135 |
| 4,539,131 | 9/1985 | Garner-Gray | 252/99 |
| 4,552,681 | 11/1985 | Koch et al. | 252/140 |
| 4,604,224 | 8/1986 | Cheng | 252/91 |
| 4,605,509 | 8/1986 | Corkill et al. | 252/131 |
| 4,639,326 | 1/1987 | Czempik et al. | 252/174.21 |
| 4,648,882 | 3/1987 | Osberghaus et al. | 252/174.25 |
| 4,666,738 | 5/1987 | Wixon | 252/174.25 |
| 4,699,729 | 10/1987 | Parr et al. | 252/174.25 |
| 4,707,290 | 11/1987 | Seiter et al. | 252/140 |
| 4,713,193 | 12/1987 | Tai | 252/91 |
| 4,720,399 | 1/1988 | Taha | 427/221 |
| 4,721,633 | 1/1988 | Baldassin | 252/174.24 |
| 4,725,455 | 2/1988 | Taha | 427/221 |
| 4,726,908 | 2/1988 | Kruse et al. | 252/91 |
| 4,731,196 | 3/1988 | Staton et al. | 252/184 |
| 4,741,862 | 5/1988 | Kosal | 252/527 |
| 4,759,865 | 7/1988 | Malihi | 252/175 |
| 4,828,721 | 5/1989 | Bollier et al. | 252/8.7 |
| 5,024,782 | 6/1991 | Finn et al. | 252/174.13 |

*Primary Examiner*—Dennis Albrecht
*Attorney, Agent, or Firm*—John A. Bucher

[57] ABSTRACT

The present invention relates to a zeolite agglomeration process and product. Zeolite particles are blended with a filler and preferably a surfactant and then agglomerated in a rotary agglomerator with a zeolite binder to form an agglomerate with about 5-70 parts by wgt. zeolite and, after drying, excellent mechanical strength and flowability with good solubilization/dispersion in aqueous solution. The zeolite agglomerate is preferably combined into a granular detergent in a second agglomeration step where the zeolite agglomerate is combined with other detergent components and sprayed with a detergent binder, the granular detergent being characterized by uniform density and particle size with minimum segregation and dusting. Both the zeolite agglomeration and detergent agglomeration steps are characterized by energy efficiency.

2 Claims, 1 Drawing Sheet

ZEOLITE AGGLOMERATION PROCESS AND PRODUCT

This is a continuation-in-part of copending application Ser. No. 07/367,392 filed on Jun. 16, 1989, now U.S. Pat. No. 5,024,000.

1. FIELD OF THE INVENTION

The present invention relates generally to detergent type agglomerates and more particularly to a zeolite agglomeration process and product.

2. Background of the Invention

This is a Continuation-in-Part of application Ser. No. 07/367,392 filed Jun. 16, 1989 now U.S. Pat. No. 5,024,782 by the same inventors and under common assignment.

Zeolites of the molecular sieve type have commonly been employed in cleansers, particularly laundry detergent compositions, as a builder to provide a water-softening function when the detergent or cleanser is placed in an aqueous solution.

Although useful with a wide variety of cleanser or detergent compositions including a variety of co-builders, zeolites have more recently been employed to replace phosphate builders.

The use of zeolites as builders in detergent compositions has been described in a number of references, including U.S. Pat. No. 4,231,887 issued Nov. 4, 1980 to Denny, et al. and U.S. Pat. No. 4,605,509 issued Aug. 12, 1986 to Corkill, et al. These references are incorporated herein as though set forth in their entirety in order to provide a further disclosure as to the use of zeolites as builders in detergent compositions.

As a general consideration, zeolites have been found to be relatively expensive and/or difficult to employ in detergent compositions for a number of reasons. Initially, zeolites tend to be incompatible with certain common detergent components such as sodium silicate, particularly in solution and under high temperature conditions. These problems of incompatibility have been discussed for example in U.S. Pat. No. 4,243,544 issued Jan. 6, 1981 to Taylor and U.K. Patent Specification 1 568 420 published May 29, 1980. The references also discussed exemplary techniques for avoiding or overcoming zeolite incompatibility with silicates. However, such techniques were also found to be relatively complex and/or expensive as noted above.

Difficulties arising during manufacture of detergent compositions with zeolite, as noted above, have often been related to particle size of the crystalline zeolites. Typically, the zeolites have a particle size of approximately 1–20 microns. Thus, if the zeolite is used in its normal state with such a particle size, it commonly presented problems of dusting or segregation in the detergent composition.

For this reason, it has been found to be generally desirable in prior practice to agglomerate the zeolite either by itself or with other components prior to combination with the detergent composition or to be agglomerated in combination with the other detergent components.

The Denny, et al. patent noted above disclosed one technique of this type wherein zeolite was combined with relatively large amounts of an ethoxylated linear alcohol and sodium citrate to form "a matrix" for the zeolite. Although this technique formed a granular zeolite which was satisfactory for its purpose, it was relatively expensive and the relatively large amounts of materials required to form the matrix limited either the amount of zeolite or the amount of other constituents in the agglomerate.

Probably a more common technique employed in the past for forming granular zeolite involved spray-drying or similar drying techniques where the zeolite was initially formed into a slurry with a large liquid component. Such techniques produced generally satisfactory characteristics and also permitted combination of other components with the zeolite. However, these techniques were based on spray-drying or the like, and tended to be expensive, particularly because of the large energy requirements for removing the substantial water or liquid component during formation of the agglomerates. Furthermore, spray-drying tended to produce a low density product, unlike the present invention.

Techniques of this type were disclosed for example by U.S. Pat. No. 4,243,545 issued Jan. 6, 1981 to Campbell, et al. That patent disclosed a detergent product with zeolite and silicate builders prepared by spray-drying.

U.S. Pat. No. 4,707,290 issued Nov. 17, 1987 to Seiter, et al. similarly disclosed a spray-dried granular adsorbent for adsorbing liquid ingredients for detergents. U.S. Pat. No. 4,096,081 issued Jun. 20, 1978 to Phenicie, et al. Disclosed particles formed from aluminosilicate, sodium sulfate and polyethylene glycol, initially with about 40% water, by spray-drying, the particulate formed by the above process further being combined with a spray-dried granular detergent product for use as a cleanser. The Taylor patent referred to above also described substantial amounts of water or liquid required in such spray-drying techniques for forming zeolite particles.

U.S. Pat. No. 4,379,080 issued Apr. 5, 1983 to Murphy also disclosed a granular detergent composition including zeolite as well as other solid and liquid components which were combined with a film-forming polymer soluble in an aqueous slurry. The combination was dried, by "spray-drying, flash-drying, microwave or oven drying" in order to form dried granules. U.S. Pat. No. 4,528,276 issued Jul. 9, 1985 to Cambell disclosed the formation of agglomerates of zeolite and silicate by addition of water and application of heat, with tumbling, for use in detergent products.

A substantial number of other references similarly discussed the formation of granular zeolites by spray-drying. However, the references noted and briefly discussed above are believed to be typical of those references, at least for purposes of the present invention.

It is to be noted that techniques other than spray-drying and the like, similarly requiring relatively high liquid or water input, have also been employed for forming granular zeolites.

U.S. Pat. No. 3,609,088 and U.S. Pat. No. 3,597,361 both issued to Sumner disclosed the use of a rotating drum for tumbling components in an agglomeration zone to form "a falling curtain of particles" to which an aqueous binder such as silicate solution or the like could be applied. The combination of the binder and the tumbling action of the rotating drum was found to result in satisfactory formation of agglomerated detergent products relatively high in phosphates and silicates with either aqueous sodium silicate or alkyl aryl sulfonic acid as a binder.

U.S. Pat. No. 4,414,130 issued Nov. 8, 1983 to Cheng also disclosed agglomerates formed from zeolite, a water soluble binder, preferably starch, and a small amount of water "by tumbling".

Although such references disclosed or suggested the formation of zeolite agglomerates by techniques other than spray-drying and the like, it remains important not only to assure that the agglomeration technique is relatively simple and inexpensive but also to assure that the agglomerates formed by the process have desirable physical characteristics such as uniform particle size, high density, hardness to resist fracture, good dispersibility, flowability, etc.

SUMMARY OF THE INVENTION

There has accordingly been found to remain a need for an improved process for forming zeolite agglomerates encompassing advantages of the type noted above while also avoiding difficulties as discussed above in connection with various references. Accordingly, all of the references noted or discussed above are incorporated herein by reference as though set forth in their entirety in order to facilitate a better understanding of the present invention.

It is therefore an object of the invention to provide a method of forming a zeolite agglomerate suitable for use as a granular detergent component, a detergent booster or a detergent by itself, the method including the steps of blending zeolite particles with a filler/-builder and a surfactant to form a zeolite blend, spraying a zeolite binder onto a falling curtain of the zeolite blend in a first agglomerator resulting in a composition of about 5–70 parts by wgt., preferably about 10–65 and more preferably about 15–65 parts by wgt. zeolite, about 10–94, preferably about 25–70, parts by wgt. filler, about 1–20 parts by wgt. surfactant, an amount of the zeolite binder effective for agglomerating the zeolite blend and at most about 20 parts, preferably at most about 10 parts by wgt. water, and then drying the composition from the first agglomerator to remove a portion of the water and yield a zeolite agglomerate having a particle size of about 0.15–1.7 mm., preferably with a majority of about 0.4–1.7 mm. and a relatively high density, for example, at least about 0.6 gm/cc., preferably at least about 0.7 gm/cc. while being characterized by uniform particle size, mechanical particle strength sufficient to resist particle fracture and good solubilization/dispersion qualities in aqueous solution.

The zeolite binder is one of a number of binders well known to those skilled in the art and is preferably a polyacrylate, present at least as a principal binding agent in order to achieve optimum mechanical particle strength in the zeolite agglomerate. The zeolite binder may also be a silicate or both a polyacrylate and silicate, added sequentially as solutions. The zeolite binder preferably includes about 1–13 parts by wgt. polyacrylate and/or about 0–8 parts by wgt. silicate, both applied as solutions.

The filler or filler/builder preferably comprises a substantial portion of an inorganic salt with low absorptivity for maximizing effectiveness of the binder. The filler/builder may be selected from the group consisting of chlorides, carbonates, sulfates, citrates, borax, borates, perborates, clays, bicarbonates, phosphates, silicates, silicas, acetates, etc. A low absorptivity filler contemplated by the invention is preferably selected from the group consisting of alkali-metal chlorides, perborates, carbonates, sulfates, and citrates; citric acid; and mixtures thereof.

The surfactant may be an anionic or cationic, for example, and is preferably a nonionic in order to enhance dispersion qualities of the zeolite agglomerate, particularly in a detergent composition.

The filler or filler/builder preferably forms at least about 10, more preferably about 25, parts by wgt. of the zeolite agglomerate and more preferably comprises about 0–60 parts by wgt. sodium chloride, about 0–60 parts by wgt. sodium sulfate, about 0–50 parts by wgt. soda ash and about 0–50 parts by wgt. perborate, the perborate also being an oxidant for the detergent composition. As noted above, the invention preferably contemplates the use of a low absorptivity filler selected from the group consisting of alkali-metal chlorides, perborates, carbonates, sulfates, and citrates; citric acid; and mixtures thereof.

It is a still further object of the invention to provide a method for forming a zeolite agglomerate as set forth above followed by the steps of adding the zeolite agglomerate with other selected detergent components to form a detergent blend composition which is then agglomerated in a second agglomerator with a detergent binder to produce a detergent agglomerate having a composition with at most about 20 parts by wgt. water and then drying the detergent agglomerate to remove a portion of the water whereupon the detergent agglomerate has a generally uniform particle size and density while being characterized by substantial freedom from segregation and dusting, particularly of the zeolite, and also exhibiting good flowability in granular form and good solubilization/dispersion qualities in aqueous solution.

It is a still further object to provide a zeolite agglomerate having a relatively high density, at least about 0.6 gm/cc., uniform particle size, mechanical strength and preferably good dispersibility while maintaining functionality of the zeolite.

It is yet a further object of the invention to provide a product of the method set forth immediately above, namely a detergent agglomerate formed in a second agglomerator from components including a zeolite agglomerate formed in a first agglomerator.

The above product preferably includes about 10–80 parts by wgt. of the zeolite agglomerate, more preferably about 10–50 parts by wgt. of the zeolite agglomerate. Most preferably, the detergent agglomerate comprises about 10–20 parts by wgt. zeolite present in the zeolite agglomerate.

Even more preferably, the detergent agglomerate as summarized above is substantially phosphate-free.

It is a still further object of the invention to provide a zeolite agglomerate suitable for use as a granular detergent component, a detergent by itself or a detergent booster, and having a composition of about 5–70, preferably 10–65 and more preferably 15–65 parts by wgt. zeolite, about 10–94, preferably about 25–70 parts by wgt. of a filler or filler/builder, about 1–20 parts by wgt. surfactant and a binder effective amount of a polyacrylate, the agglomerate upon drying having a uniform particle size range of about 0.15–1.70 mm., a relatively high density of at least about 0.6 gm/cc. and characterized by mechanical particle strength suitable for resisting particle fracture and good solubilization/dispersion qualities in aqueous solution.

It is a related object to provide such a zeolite agglomerate including a low absorptivity filler providing a nucleus of seed with inorganic salt such as sodium chloride the filler providing a nucleus or seed with zeolite and binder and preferably surfactant forming a shell adhering to the surface of the filler seed. More preferably, the zeolite agglomerate is agglomerated with other detergent components, some of which adhere to the zeolite agglomerate. The zeolite agglomerate is also preferably substantially phosphate-free for environmental purposes. Preferred low absorptivity fillers are discussed above and described in greater detail below.

It is a related object of the invention to provide a product of the method or process as set forth above.

Additional objects and advantages of the invention are made apparent in the following description of preferred embodiments of the invention, having reference to the accompanying drawings.

Figure 1:
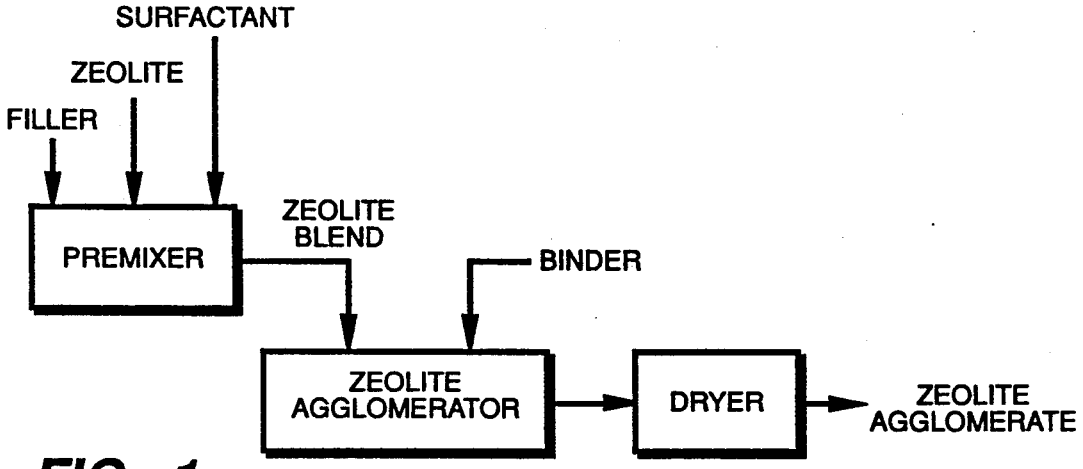
FIG. 1 is a flow chart illustrating use of a first agglomerator and subsequent dryer to form a zeolite agglomerate according to the present invention.
Figure 2:
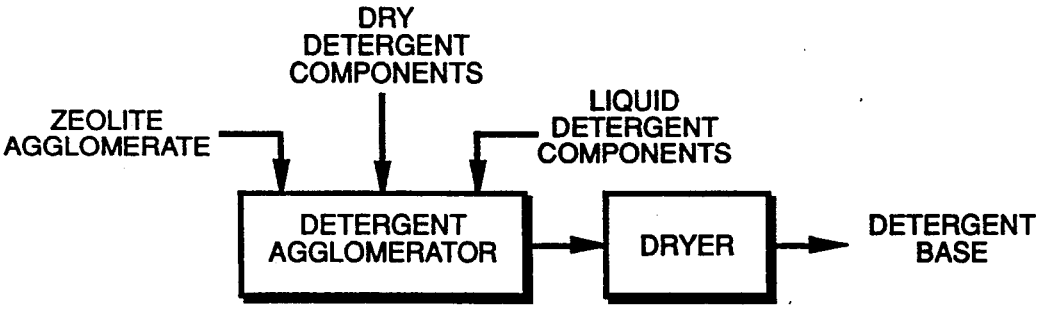
FIG. 2 is a similar flow chart, adapted to follow the flow chart of FIG. 1 where the zeolite agglomerate is to be combined into a granular detergent product, FIG. 2 illustrating operation of a second agglomerator and dryer for forming a detergent agglomerate, preferably a base product for a finished detergent product.
Figure 3:
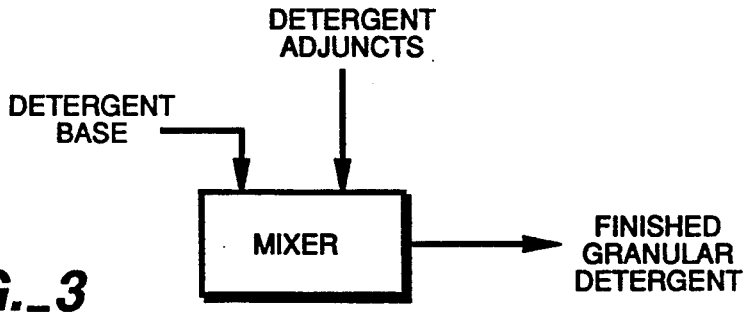
FIG. 3 is yet another flow chart, preferably adapted to follow the flow chart of FIG. 2 and illustrating operation of a mixer for adding various adjuncts as desired to the detergent base from the flow chart of FIG. 2 in order to produce a finished detergent product.

Thus, FIGS. 1-3, taken together, provide a flow sheet for the process of the invention to form a finished detergent product.

DESCRIPTION OF THE PREFERRED EMBODIMENTS

As outlined above, the present invention initially discloses a method for forming a zeolite agglomerate suitable for use as a granular detergent component, a detergent booster or a detergent product by itself. The invention also provides a product or products thereof.

Where the zeolite agglomerate is to be used as a granular detergent component, the method as summarized above includes additional steps for combining the zeolite agglomerate into a detergent agglomerate. Thus, the zeolite agglomerate is formed in a first zeolite agglomerator by addition of a zeolite binder while the detergent agglomerate is formed in a second agglomerator by addition of a detergent binder. A granular detergent product of the method or process summarized immediately above is also provided by the invention.

In addition to providing a granular detergent product of enhanced physical characteristics including minimal segregation or dusting, particularly of zeolite, the granular detergent product is also characterized by good flowability and good solubilization/dispersion characteristics in aqueous solution.

The various aspects of the invention as summarized above are described in greater detail below as follows. Initially, the method or process for forming the zeolite agglomerate is described followed by a description of the preferred composition and novel physical characteristics of the resulting zeolite agglomerate. Thereafter, the process or method for forming a granular detergent, including the zeolite agglomerate as a component, is described followed by a description of a preferred composition for the detergent and novel physical characteristics for the detergent product. An experimental section is set forth thereafter with specific examples of the methods or processes and products of the invention.

Additional advantages of the invention are also described in greater detail below. Particularly in connection with the overall method or process for forming the granular detergent, the invention particularly contemplates formation of the zeolite agglomerate in a first agglomerator of preferred design with the detergent product or agglomerate being formed in a second agglomerator, preferably of a vertical type.

Use of the two agglomerators in series together with preferred compositions of the zeolite agglomerate and detergent agglomerate result not only in novel and enhanced physical characteristics of the granular detergent product but also in a novel advantage of energy efficiency. More specifically, only minimum water or liquid is present in the components in each agglomerator, thereby minimizing the amount of drying required after each agglomeration step.

Referring now to the drawing and particularly to FIG. 1, an initial method or process is contemplated by the invention for forming a zeolite agglomerate. The specific composition of the zeolite agglomerate is of course dependent upon whether the agglomerate is to be employed as a granular detergent component or a detergent booster or as a detergent by itself.

The zeolite agglomerate includes zeolite, generally in the range of about 5-70 parts by wgt., preferably about 10-65 and more preferably about 15-65 parts by wgt. Zeolites of the type contemplated by the present invention are generally well known and particularly preferred as optional co-builders in detergent compositions since they perform well and do not form precipitates with water hardness ions. The present invention contemplates either a single zeolite or a combination of zeolites of the type generally referred to as detergent grade zeolites which are well known to those skilled in the art and which typically have a particle size in the range of about 1-20 microns as noted above. Suitable zeolites include synthetic aluminosilicates based on the anhydrous formula $Na_2O.Al_2O_3.SiO_2$.

A filler is combined with the zeolite in order to enhance interaction of the zeolite with a zeolite binder necessary for forming the agglomerate. These three components in combination are principally responsible for the desired physical characteristics of the zeolite agglomerate as described in greater detail below.

The filler preferably includes a substantial portion of an inorganic salt such as sodium chloride having a low degree of absorptivity in order to enhance functioning of the zeolite binder. In addition, the filler may be a filler/builder with other components serving also as co-builders with the zeolite and performing additional functions as well. As may be seen from the preferred composition for the zeolite agglomerate as set forth below, the filler/builder preferably includes various amounts of inorganic salts, carbonates, sulfates, citrates, borax, borates and/or perborates, clays, bicarbonates, phosphates, silicates, silicas, acetates, etc. Although the perborate is capable of functioning as a filler in the zeolite agglomerate, it otherwise performs as an oxidant rather than as a builder. A low absorptivity filler contemplated by the invention is preferably selected from the group consisting of alkali-metal chlorides, perborates, carbonates, sulfates, and citrates; citric acid; and mixtures thereof.

The zeolite agglomerate may also include various other substituents, preferably selected from conventional detergent components in order to enhance performance of the zeolite agglomerate. In particular, the zeolite agglomerate is contemplated as including a surfactant or blend of surfactant, especially for the purpose of enhancing dispersion of the zeolite agglomerate and/or a granular detergent product including the zeolite agglomerate. A wide variety of surfactants can be employed for this purpose. Preferably, the surfactant is a nonionic type but may be an anionic, cationic, zwitterionic, etc.

It is again noted that the zeolite agglomerate may also be adapted to include other substituents or detergent components. The same two references noted above may be consulted in order to identify suitable detergent components for possible combination within the zeolite agglomerate of the present invention.

The binding agent for the zeolite agglomerate may be any of a number well known to those skilled in the art and discussed in one or more references incorporated herein. However, the binding agent preferably comprises polyacrylate either by itself or as a principal binder in order to achieve the optimum physical particle characteristics of the invention. However, the zeolite binder could also be a silicate or both a polyacrylate and a silicate, added sequentially as solutions. In such an event, the silicate solution may be employed to advantage in combination with the polyacrylate, for example, to delay release of the polyacrylate if desired. However, as noted above, the zeolite binder preferably comprises a polyacrylate in order to provide superior hardness and/or durability in the agglomerates, suitable for example to permit transport of the zeolite agglomerate by pneumatic conveyer. Use of the polyacrylate as a single or principal binder also tends to avoid possible problems of incompatibility between the zeolite and silicate at high temperatures and upon aging.

The polyacrylates referred to above are also termed polycarboxylic acids. Both homopolymers and copolymers of various types are suitable. An example of a commercial source for such a product is the series of polyacrylates available from the Rohm and Haas Company under the trade name ACUSOL.

Silicate solutions may include one or more of a number of alkali-metal silicates also well known to those skilled in the art. A preferred silicate is sodium silicate having a silicon dioxide to sodium oxide ratio of between about 1 and 3.2, more preferably about 2.4. In addition to acting as a binder component, the silicates exhibit anti-corrosive effects, provide alkalinity and aid in cleaning, especially on oil and grease stains.

The composition of the zeolite agglomerate may also be used to particular advantage for applications where it is desirable to avoid phosphates for environmental reasons as discussed above. Accordingly, the present invention particularly contemplates the zeolite agglomerate as preferably being phosphate-free.

The initial process or method of zeolite agglomeration is carried out principally in a rotary drum agglomerator of a type described, for example, in O'Brien U.S. Pat. No. 3,580,545 noted above and incorporated by reference in order to provide a detailed description of the agglomerator.

Generally, the agglomerator includes a rotating drum including axially extending bars about its periphery for agitating and mixing material within the drum and generally for producing a falling curtain of material. A liquid component such as the binding agent of the present invention is then uniformly sprayed onto the falling curtain of material. The combination of the zeolite agglomerate components as described above is thus combined within the agglomerator. Agitation of the components by the bars tends to rotate and break up the material, resulting in formation of a uniform agglomerate according to the present invention.

Preferably, the zeolite particles and other dry components, principally one or more filler components and the surfactant are pre-mixed in a separate mixer but may also be combined and pre-mixed in the O'Brien agglomerator schematically illustrated in FIG. 1. In any event, the zeolite binder, preferably polyacrylate, is then sprayed onto the zeolite blend from the prior mixing step together with agitation produced by the O'Brien agglomerator in order to produce the zeolite agglomerate. In the agglomerator, the tumbling or rolling action of the drum allows granules formed from the zeolite and other solid components together with the binder to gradually increase in size. The filler, preferably sodium chloride, acts as a seed to which the zeolite crystals adhere during formation of the zeolite agglomerates. In addition to sodium chloride, other more preferred low absorptivity fillers include soda ash, perborates such as sodium perborate, citrates such as sodium citrate and citric acid as well as mixtures of those materials with each other and with sodium chloride. Thus, the duration of the agglomeration step within the O'Brien agglomerator is controlled in order to regulate particle size of the resulting agglomerate, which is of generally uniform size.

The zeolite agglomerates formed in the O'Brien agglomerator are relatively fragile and are accordingly transferred to a rotary dryer, for example, in order to condition and dry the agglomerates. The free water added with the binder to form the agglomerates is substantially removed during this drying stage in order to produce the zeolite agglomerates with superior physical characteristics according to the present invention of hardness or durability as well as uniform size.

The zeolite agglomerate is further characterized by a nucleus or seed of low absorptivity filler, preferably an inorganic salt, with the zeolite and binder and preferably surfactant forming a shell adhering thereto. In the second agglomerator, other detergent components tend to adhere to the zeolite agglomerate.

As noted above, the specific composition, particle size and density of the zeolite agglomerate may be varied depending upon the contemplated application for the agglomerate. In some cases, such characteristics may enhance consumer acceptance.

The zeolite agglomerate produced by the method of the present invention results in particularly uniform size particles and is characterized by excellent dispersion characteristics, particularly because of the incorporated surfactant. Improved dispersion characteristics for the zeolite agglomerate are further set forth in one of the following examples.

In addition, the zeolite agglomerate of the present invention, after drying, is particularly characterized by improved mechanical strength sufficient to resist particle fracture. Mechanical strength or frangibility of the zeolite agglomerate has been found to be suitable for permitting transfer of the agglomerate by conventional pneumatic conveying machines without significant fracture of the particles. Preferably, mechanical strength of the zeolite agglomerate of the present invention in this regard is sufficient to resist particle fracture during transfer by conventional pneumatic conveying apparatus. For example, a dilute phase pneumatic conveying system typically has a material weight to air weight ratio of between about 5:1 and 40:1, preferably between about 7:1 and 10:1, with an air velocity or flow rate of about 1800–6500 ft./min., preferably about 4500–5400 ft /min., at about 10 psig.

Furthermore, the dispersion rates and calcium binding capacities for zeolite agglomerates formed in accordance with the present invention were assessed in comparison with zeolite powder.

The dispersion studies were carried out using a dipping probe colorimeter (Brinkmann PC 800) with a 2 cm path length dipping probe. The colorimeter was connected to an x-y chart recorder. The relative dispersion rates were determined by measurement of the percent transmittance (%T) as a function of time upon addition of the zeolite agglomerate under a specific set of experimental conditions. The %T was set to 100% before adding the agglomerate to distilled water. Studies were carried out in 1 liter of solution with the temperature maintained at about 10° C. with a water bath. Uniform stirring was maintained with a programmable stir plate set at 200 RPM. The agglomerates were examined at about 0.29 gm zeolite/liter corresponding to a use level in a washing machine of 20 gm zeolite/68 liters. As the zeolite disperses, the %T decreases to a constant level. A plot of %T as a function of time can then be generated to show when the material is completely dispersed.

The zeolite agglomerates tested generally had a stable equilibrium value for transmittance (%T) after about one minute for each of the agglomerates, ranging from about 30–40%, for the zeolite agglomerates of Example 1 below. This is the same as the results for zeolite powder. The %T values for the agglomerates indicate that, even at 10° C., they dispersed within one minute, as did the zeolite powder. This is largely attributed to the incorporation of nonionic surfactant into the agglomerate which was shown previously to significantly improve dispersibility.

Even at 2° C., the zeolite agglomerates of the present invention exhibited good dispersibility as shown by half lives in the range of about 9 to 12 seconds. For purposes of the present invention, half life is defined as the time necessary to achieve one half of the equilibrium dispersion value. By comparison, pure zeolite powder exhibited a half life of about 4 to 6 seconds. Thus, the half life values for the zeolite agglomerates and the zeolite powder were not significantly different compared to the length of time for the wash cycle.

Calcium binding capacities were determined at room temperature by quantitating the remaining free $Ca^{+2}$ ion concentration upon addition of the agglomerate to a solution containing a known initial concentration of $Ca^{+2}$ ions. Vigorous stirring was maintained throughout the procedure. Aliquots were removed at various times and filtered through a 0.8 micron filter disk on a syringe to remove the insoluble zeolite, then titrated with standardized EDTA to give the free calcium concentration remaining in solution. (It is essential that the initial $Ca^{+2}$ ion concentration be in excess of the amount sequestered by the zeolite). Samples were taken until the remaining free $Ca^{+2}$ concentration was unchanged indicating that equilibrium binding had been achieved. For very rapid dissolving samples, equilibrium was generally established in 10–20 minutes. The calcium concentrations are related by:

$$Ca^{+2}_{bound} = Ca^{+2}_{initial} - Ca^{+2}_{final}$$

The calcium binding capacities for the agglomerates, when corrected for percentages of zeolite present, ranged between about 185–222 mg $CaCO_3$/gm zeolite for the zeolite agglomerate of Example 1 below. The binding capacities of the agglomerates corrected for the actual zeolite level is lower than for the zeolite powder (about 215–240 mg $CaCO_3$/gm of hydrated zeolite) which is in part due to ionic strength effects from the inorganic salt/filler. The slightly lower binding capacity level does not interfere with practice of the present invention. There is currently insufficient data to correlate the calcium binding capacity of zeolite to the performance of a detergent matrix. The consistency of the calcium binding capacities of the samples of the invention suggest that the affected by the ranges of the processing temperatures tested.

It is concluded that the zeolite agglomerates of the invention which contain nonionic surfactant show excellent cold water dispersibility. The calcium binding capacities suggest that the zeolite functionality was not significantly affected by the process.

In a further part of the process or method according to the present invention, where the zeolite agglomerate is preferably a component in a detergent base, agglomeration of the granular detergent base is carried out in a second agglomerator adapted for agitating various detergent blend components while they are uniformly coated with a liquid component including a detergent binder and possibly additional surfactant.

A preferred agglomerator for carrying out this step is known generally as a vertical agglomerator of a type available, for example, from Bepex Corp. under the trade names Schugi or Turboflex.

The Schugi agglomerator is characterized by relatively minimal residence time for a material to be agglomerated therein. It is furthermore a vertical agglomerator in that the solid detergent components and the zeolite agglomerates are charged to the top of the agglomerator and allowed to fall under gravity through an agglomeration chamber. The agglomeration chamber includes a number of blades mounted for rotation on an axially arranged vertical shaft. The lateral walls of the Schugi agglomerator are formed by elastomeric material in a cylindrical configuration with external means for flexing or kneading the elastomeric walls in order to remove material deposited thereon.

During operation, the detergent components falling through the chamber are agitated by the blades and, at the same time, are uniformly sprayed with the liquid component including the detergent binder and optionally a surfactant. The granules formed by combination of the solid detergent components with the liquid components are deposited upon the elastomeric walls from where they pass downwardly and out of the chamber.

This type of agglomerator has been found satisfactory in the past for forming detergent agglomerates of generally uniform size, at least from components of generally similar size ranges. The small particle size and absorptivity of the zeolite powder make it difficult to produce a high quality, uniform particle size product with only the second agglomeration step in the second agglomerator as described above.

In the above process, a relatively wide variety of detergent components may be combined in the second detergent agglomerator.

The surfactants in the liquid component preferably include one or more nonionic surfactants either alone or in combination with one or more anionic surfactants. However, various other surfactants as disclosed in the above references may also be used.

The granular detergent or detergent agglomerate leaving the second agglomerator is also dried, preferably in a fluid bed dryer such as those provided by Bepex Corp.

In a third portion of the method or process of the invention, as illustrated in FIG. 3, the dried detergent agglomerates from the second agglomerator are blended with additional detergent adjuncts as desired in a simple mixer. Suitable detergent adjuncts are also identified in the above noted and incorporated references. For example, such adjuncts preferably include enzymes, brighteners, bluing agents, colorants, oxidants, bleach activators, a fragrance component, etc.

The granular detergent or detergent agglomerate produced in the method or process set forth above was characterized by uniform particle size in a range of 0.15–1.7 mm., density in the range of at least about 0.5 gm/cc., preferably about 0.6–0.7 gm/cc., minimal segregation and dusting and good flowability.

The following examples are set forth to better illustrate preferred processing methods and compositions according to the invention.

EXAMPLE 1

Example I demonstrates the method and a preferred composition for forming a zeolite agglomerate according to the present invention.

Zeolite 4A particles having a mean particle size of about 4–5 microns were blended with sodium chloride as a filler and nonionic surfactant in a combination of 16 parts by wgt. of zeolite, 12 parts by wgt. sodium chloride and 2.6 parts by wgt. nonionic surfactant.

The zeolite blend was charged to an O'Brien agglomerator as described above and combined, during agitation, with 1.2 parts by wgt. of a low molecular weight polyacrylate binding agent. The combination of the zeolite blend and binder in the first O'Brien agglomerator included about 1.6 parts by wgt. of water added with the binder.

Agitation in the O'Brien agglomerator was continued until the zeolite agglomerates produced therein had a mean particle size of about 0.5 mm. and a density of about 0.9 gm/cc.

The relatively fragile zeolite agglomerates from the O'Brien agglomerator were transferred to a rotary drum dryer wherein the zeolite agglomerates were dried under conditions of 130° C. air. About 80 percent of the water (available) was removed from the zeolite agglomerates in the dryer to result in zeolite agglomerates according to the invention characterized by uniform particle size with a mean of about 0.5 mm., density of about 0.9 gm/cc., physical characteristics of good mechanical strength and good solubilization/dispersion characteristics in aqueous solution.

The zeolite agglomerates produced by this example were satisfactory for use either as a simple detergent by themselves, as a detergent booster or as a component in a granular detergent as described below in Example 2.

Both the operating parameters within the O'Brien agglomerator and the composition described above in Example 1 could be varied as discussed in greater detail above in order to provide zeolite agglomerates of different compositions but with similar desirable physical characteristics.

EXAMPLE 2

In this example, the zeolite agglomerates of Example 1 were combined with other detergent components to form a detergent base.

The process or method of the invention was carried out principally in a Schugi vertical agglomerator as described above. Initially, the zeolite agglomerate from Example 1 (about 32 parts by wgt.) was blended with other dry detergent components as identified in the above table. These components include sodium carbonate (36 parts by wgt.), sodium chloride (5.4 parts by wgt.) and perborate (4 parts by wgt.). This blending step was preferably carried out within the Schugi agglomerator itself but could also readily be performed in a separate blender or mixer.

Thereafter, with the blended detergent components being agitated in the Schugi agglomerator, a liquid was sprayed thereon. These liquid components include anionic surfactants (8 parts by wgt.) and binder including polyacrylate (1.6 parts by wgt.) and silicate (4.5 parts by wgt.). The components in the Schugi agglomerator included the detergent blend, the detergent binder and about 8.3 parts by wgt. of water.

The detergent agglomerates from the Schugi agglomerator were transported to a fluid bed dryer wherein about 45 percent of the available water was removed to form the detergent agglomerated described immediately below.

The detergent agglomerates leaving the agglomerator had a mean particle size of about 0.6 mm., a density of about 0.7 gm/cc. and were characterized by minimal segregation and dusting as well as good flowability in granular form and good solubilization/dispersion characteristics in aqueous solution.

The detergent agglomerate that formed a detergent base from Example 2 was preferably combined with about 3 parts by wgt. of various adjuncts to form a finished granular detergent product.

EXAMPLES 3–8

In Examples 3–8, zeolite agglomerates were formed in a similar manner as described for Example 1. The composition of Examples 3–8 were varied as indicated in the following table. The values shown in the table below are in parts by weight and do not necessarily account for the total weight of the composition.

| | Composition of Examples 3–8 | | | | | |
|---|---|---|---|---|---|---|
| COMPONENT | Ex.3 | Ex.4 | Ex.5 | Ex.6 | Ex.7 | Ex.8 |
| Zeolite | 59 | 46 | 45 | 49 | 33 | 60 |
| Sodium chloride | — | 32 | 9 | 39 | — | — |
| Soda ash | — | — | 22 | — | 38 | — |
| Perborate tetrahydrate | — | 11 | 11 | — | — | — |
| Perborate monohydrate | 15 | — | — | — | — | — |
| Citric Acid | — | — | — | — | 11 | — |
| Sodium Citrate | — | — | — | — | — | 20 |
| Nonionic surfactant | 18 | 8 | 8 | 8 | 12 | 17 |
| Polyacrylate | 9 | 3 | 4 | 3 | 6 | 3 |
| Bulk Density | 0.79 | 0.97 | 0.83 | 0.95 | 0.84 | NA |

As noted above, the zeolite agglomerates for Examples 3–8 were formed in the same manner described above for Example 1 with minor variations compensating for the different components as is well known to those skilled in the art.

In each of Examples 3–8, the zeolite particles also had a mean particle size of about 4–5 microns, the non-ionic surfactant was obtained under the trade name NEODOL from the Shell Chemical Company, and the polyacrylate being a low molecular weight polyacrylate binding agent with a concentration of about 35 percent in water.

Considering Example 1 together with Examples 3–8, the preferred low absorptivity filler for the present invention is sodium chloride because of its excellent solubility and low cost in addition to low absorptivity and its particular suitability in the final product. However, the other low absorptivity fillers included in Examples 3–8 were also found suitable for forming the zeolite agglomerates of the present invention. The perborate employed in Examples 3 and 4 was sodium salt, however perborates formed with alkali metals other than sodium could be employed in the invention.

In addition to the specific examples set forth above, the invention also contemplates variations of those examples wherein citrates, particularly sodium citrate, for example is substituted entirely or in part for other low absorptivity fillers, particularly sodium chloride in Example 1. Where citrates (or citric acid) are employed as the low absorptivity salt, it may be possible to reduce the level of zeolite or other builder, as the citrates also function as builders. An additional low absorptivity filler is an alkali-metal sulfate, which can similarly be substituted entirely or in part for the other low absorptivity fillers, particularly sodium chloride.

There have thus been described above a number of variations of zeolite agglomerates suitable for use by themselves or in detergent compounds, detergent compounds formed from the zeolite agglomerates and methods for forming both the zeolite agglomerates and the finished detergent. Accordingly, the scope of the present invention is defined only by the following appended claims which are further exemplary of the invention.

What is claimed is:

1. A zeolite agglomerate for use as a granular detergent component, a detergent booster or a detergent by itself, comprising about 5–70 parts by wgt. zeolite, about 10–94 parts by wgt. of a low absorptivity filler material selected from the group consisting of alkali-metal chlorides, carbonates, perborates, sulfates, citrates, citric acid, and mixtures of the foregoing with each other, the filler comprising a substantial portion of sodium chloride with low absorptivity, an amount of a selected binder effective for binding the agglomerate, and about 1–20 parts by wgt. of a nonionic surfactant, the agglomerate formed therefrom having a particle size range of about 0.15–1.7 mm. and a density of at least about 0.6 grams/cc., the agglomerate further having mechanical particle strength suitable for resisting particle fracture and also having a nucleus formed from the low absorptivity material as a seed for the agglomerate with the zeolite and binder forming a shell adhering to the surface of the filler seed, the agglomerate being further characterized by good solubilization and dispersion qualities in aqueous solution.

2. A method of forming a zeolite agglomerate suitable for use as a granular detergent component, a detergent booster or a detergent by itself, comprising the steps of blending zeolite particles of about 1–20 micron size with a filler and a surfactant to form a zeolite blend, the filler being selected from the group consisting of alkali-metal chlorides, carbonates, perborates, sulfates, citrates, citric acid and mixtures of the foregoing with each other, charging the zeolite blend to a first agglomerator, spraying a zeolite binder selected from the group consisting of a polyacrylate, a silicate and combinations thereof, onto the zeolite blend in the first agglomerator with a composition entering the first agglomerator of about 5–70 parts of wgt. zeolite, about 10–94 parts by wgt. filler, about 1–20 parts by wgt. surfactant, an amount of the zeolite binder effective for agglomerating the zeolite blend and at most about 20 parts by wgt. water, drying the zeolite agglomerate from the first agglomerator to remove a portion of the water and to form the zeolite agglomerate having a particle size of about 0.15–1.7 mm. and a density of at least about 0.6 gm/cc. while being characterized by mechanical particle strength sufficient to resist substantial particle fracture and good solubilization/dispersion qualities in aqueous solution, charging the zeolite agglomerate and other detergent components to a second agglomerator to form a detergent composition, spraying the detergent composition with a detergent binder while agitating the detergent composition in the second agglomerator to produce a detergent agglomerate having a composition with at most about 20 parts by wgt. water added with the binder, and drying the detergent agglomerate to remove a portion of the water and form the detergent agglomerate to have a generally uniform particle size and density while being characterized by substantial freedom from segregation and dusting and exhibiting good solubilization and dispersion qualities in aqueous solution.

* * * * *